US008784279B2

(12) United States Patent
Cantrell

(10) Patent No.: US 8,784,279 B2
(45) Date of Patent: Jul. 22, 2014

(54) PELVIC CLAMP FOR BACK STRETCHING

(76) Inventor: Wayne Cantrell, Suwanee, GA (US)

( * ) Notice: Subject to any disclaimer, the term of this patent is extended or adjusted under 35 U.S.C. 154(b) by 0 days.

(21) Appl. No.: 11/290,357

(22) Filed: Nov. 30, 2005

(65) Prior Publication Data

US 2007/0123402 A1 May 31, 2007

(51) Int. Cl.
*A63B 71/00* (2006.01)
*A63B 26/00* (2006.01)
*A63B 23/00* (2006.01)

(52) U.S. Cl.
USPC ..... 482/91; 482/907; 482/142; 482/148; 482/139

(58) Field of Classification Search
USPC ..... 482/148, 907; D21/695; 602/32, 33, 36, 602/39, 5, 12, 16, 19; 5/600, 943, 630, 634, 5/621, 628, 648, 650; 128/845, 846, 869, 128/870, 876
IPC ..... A63B 1/00
See application file for complete search history.

(56) References Cited

U.S. PATENT DOCUMENTS

| | | | | | |
|---|---|---|---|---|---|
| 4,752,067 | A | | 6/1988 | Colonello | |
| 4,979,732 | A | * | 12/1990 | Rushatz et al. | 482/148 |
| 5,390,383 | A | * | 2/1995 | Carn | 5/624 |
| 5,449,335 | A | * | 9/1995 | Steinfeld | 482/110 |
| 5,462,518 | A | * | 10/1995 | Hatley et al. | 602/36 |
| 5,484,393 | A | * | 1/1996 | McCoy | 602/6 |
| 5,575,027 | A | * | 11/1996 | Mueller | 5/621 |
| 5,637,079 | A | | 6/1997 | Miller | |
| 5,830,169 | A | * | 11/1998 | Pierce | 602/32 |
| 6,003,176 | A | * | 12/1999 | Wasley et al. | 5/624 |
| 6,066,109 | A | * | 5/2000 | Buser et al. | 602/23 |
| 6,110,194 | A | | 8/2000 | Saber | |
| 6,240,923 | B1 | * | 6/2001 | Barrick | 128/869 |
| 6,298,507 | B1 | * | 10/2001 | Clyburn | 5/623 |
| 6,302,859 | B1 | | 10/2001 | Cushman | |
| 6,311,349 | B1 | * | 11/2001 | Kazakia et al. | 5/624 |
| 6,368,296 | B1 | * | 4/2002 | Eiter et al. | 602/19 |
| 6,592,501 | B1 | * | 7/2003 | Mayes | 482/142 |
| 6,622,324 | B2 | * | 9/2003 | VanSteenburg et al. | 5/621 |
| 6,666,801 | B1 | * | 12/2003 | Michalow | 482/137 |
| 6,820,621 | B2 | * | 11/2004 | DeMayo | 128/845 |
| 6,934,987 | B2 | * | 8/2005 | Newkirk et al. | 5/613 |
| 6,941,951 | B2 | * | 9/2005 | Hubert et al. | 128/845 |
| 7,201,729 | B2 | * | 4/2007 | Emsky | 602/33 |
| 2001/0047142 | A1 | * | 11/2001 | Manoach | 602/13 |
| 2003/0017925 | A1 | * | 1/2003 | Hoffman | 482/148 |
| 2003/0167569 | A1 | * | 9/2003 | Newkirk et al. | 5/613 |
| 2005/0227837 | A1 | * | 10/2005 | Broadbent | 482/148 |
| 2006/0116262 | A1 | * | 6/2006 | Pandozy | 482/142 |

FOREIGN PATENT DOCUMENTS

| | | | | |
|---|---|---|---|---|
| DE | 10027458 | A1 | * | 12/2001 |
| EP | 581757 | A1 | * | 2/1994 |

* cited by examiner

*Primary Examiner* — Glenn Richman
*Assistant Examiner* — Sundhara Ganesan
(74) *Attorney, Agent, or Firm* — Robert J. Veal; Veal Intellectual Property

(57) ABSTRACT

A pelvic clamp for back stretching is disclosed which provides temporary relief for low back pain by employing means for stretching the lumbar region. Embodiments which provide this means for stretching include a cam stop assembly, a block stop assembly, a slide panel assembly and a bend rod assembly. Each of these assemblies works by squeezing the sides of the pelvic region in order to hold it stationary while the user exerts pressure on assembly elements to force the upper torso away from the pelvic region.

6 Claims, 22 Drawing Sheets

PELVIC CLAMP FOR BACK STRETCHING

FIELD OF THE INVENTION

The present invention relates to the field of back pain. In particular, the present invention relates to a device for physical exercise and temporary relief of back pain.

BACKGROUND OF THE INVENTION

Low back pain is very common today and has most likely existed before recorded history, e.g. due to carrying a heavy kill to a cave. It is estimated that 20% of the adult population is afflicted with chronic low back pain today, and 60% of the adult population will be afflicted by chronic low back pain at some time during their lifetime.

By far the best medicine for most skeletal/muscular ailments is exercise. Physical therapists recommend stretching our muscles before we exercise. However, a person cannot exercise if he is in so much pain that he cannot get up to do the exercise.

Since low back pain is such a common problem many devices have been invented that attempt to solve it. These devices attempt to resolve this problem with all kinds of methods, including hanging upside down, bending over backwards and stretching the entire body. Most of these inventions require participation of the user and require some amount of physical exertion which puts these inventions in the class of exercise devices. These exercise devices are generally complicated and take some time to prepare the user due to the strapping of the user into the device and the adjusting of the device to fit the user.

Existing devices for relief of back pain have several other problems. Some stretching devices work by requiring one end of the user's extremities to be stationary while the other is pulled in the opposite direction. Other inventions require considerable preparation by positioning the user in contorted positions, e.g. strap on a harness, position it, adjust it, take a measurement, calibrate the equipment, and other elaborate maneuvers. Some of the inventions are motorized and/or computerized, and require the supervision of another person, e.g., a doctor or chiropractor. These inventions generally have a lot of parts and are usually expensive.

These and other problems exist. Previous attempts to solve these and other problems include the following.

U.S. Pat. No. 6,110,194, issued to Kirk Saber on Aug. 29, 2000, discloses an alignment apparatus for spinal chord of human beings comprised of a board which includes channel and channel extends along length direction parallel to edges.

U.S. Pat. No. 5,637,079, issued to Richard P. Miller on Jun. 10, 1997, discloses a self contained portable traction apparatus that has a frame with two tensile force application devices and two frames which have parallel elongate struts.

U.S. Pat. No. 4,752,067, issued to Dennis J. Colonello on Jun. 21, 1988, discloses an exercise appliance for lower part of body having a backward curved part, a rocker part and a pelvis part.

While these patents and other previous methods have attempted to solve the above mentioned problems, none have utilized a combination of levers and squeeze panels in a portable device to target the area to be stretched.

Therefore, a need exists for an improved pelvic clamp for back stretching that addresses the above mentioned problems.

The foregoing patent and other information reflect the state of the art of which the inventor is aware and are tendered with a view toward discharging the inventor's acknowledged duty of candor in disclosing information that may be pertinent to the patentability of the present invention. It is respectfully stipulated, however, that the foregoing patent and other information do not teach or render obvious, singly or when considered in combination, the inventor's claimed invention.

BRIEF SUMMARY OF THE INVENTION

To achieve the foregoing and other advantages, the present invention, briefly described, provides a back stretching device. In particular, the present invention provides a back stretching device that provides temporary relief for low back pain. The present invention employs means for stretching the lumbar region. Assemblies which provide this means for stretching include a cam stop device, a block stop device, a slide panel device and a bent rod device. Each of these assemblies works by squeezing the sides of the pelvic region in order to hold it stationary while the user exerts pressure on assembly elements to force the upper torso away from the pelvic region.

The present invention targets the area to be stretched to the area between the hips and the shoulders. This minimizes the possibility of incurring neck and leg pain from using the device. The present invention is very simple to operate and takes very little time to prepare to use. The user simply lies on his back with his hips on the top of the invention base, positions himself so that the tips of two squeeze panels contact the soft tissue between the pelvis and top of the femur on each side; chooses the adjustment hole in the bottom of the squeeze panel for comfort and firm fit, then the user exerts pressure on two levers to engage the squeeze panels to hold the user's pelvic area stationary. While continuing to exert pressure on the levers with varying degrees of force, the user will effectively counter push the shoulders and upper torso away from the hips to stretch the lumbar area. Used properly the present invention can offer immediate relief from chronic back pain. Through regular use the present invention not only will relieve low back pain but also over time will allow the user to strengthen the muscles around the targeted area and help the user to return to a normal life style.

Before explaining at least one preferred embodiment of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

One advantage of the present invention is to provide a pelvic clamp for back stretching that targets the midsection of the body.

Another advantage of the present invention is to provide a pelvic clamp for back stretching that can be self operated without doctor supervision.

Another advantage of the present invention is to provide a pelvic clamp for back stretching that is easy to use.

Another advantage of the present invention is to provide a pelvic clamp for back stretching that is inexpensive.

Another advantage of the present invention is to provide a pelvic clamp for back stretching that is portable.

Another advantage of the present invention is to provide a pelvic clamp for back stretching that can be made of readily available materials.

Another advantage of present invention is that it is very portable and light weight. It can easily be moved from the bedroom to the exercise room and even be taken on trips.

The provision of this more simple and cost effective device has not been contemplated by the prior art. Nor does the prior art described above teach or suggest a pelvic clamp for back stretching which may be used by individuals of varying skill and strength levels, as well as people of varying ages. In the existing art, many of the devices are expensive to manufacture and are not easily portable. The foregoing disadvantages are overcome by the unique structure of the present invention as will be made apparent from the following description thereof. Other advantages of the present invention over the prior art also will be rendered evident.

BRIEF DESCRIPTION OF THE SEVERAL VIEWS OF THE DRAWINGS

Other advantages and features of the invention are described with reference to exemplary embodiments, which are intended to explain and not to limit the invention, and are illustrated in the drawings in which.

DETAILED DESCRIPTION OF THE INVENTION

Figure 1:
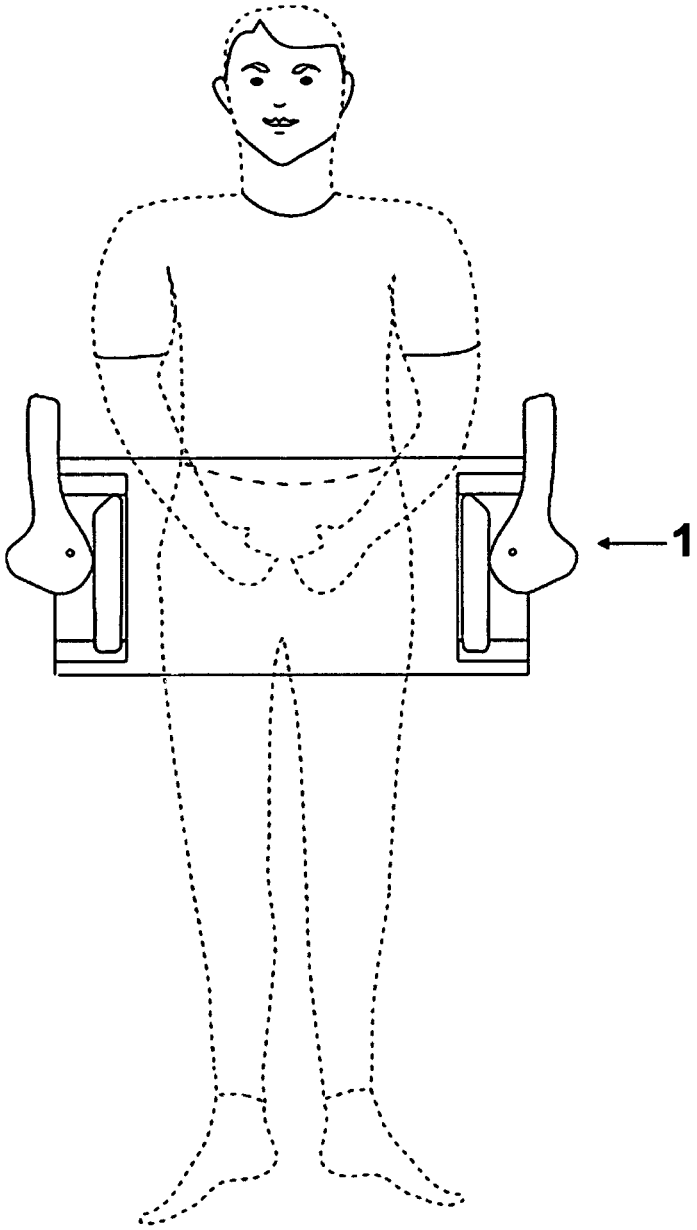
FIG. 1 shows the positioning of a person preparing to use a cam stop embodiment, the preferred embodiment, of the present invention.
Figure 2:
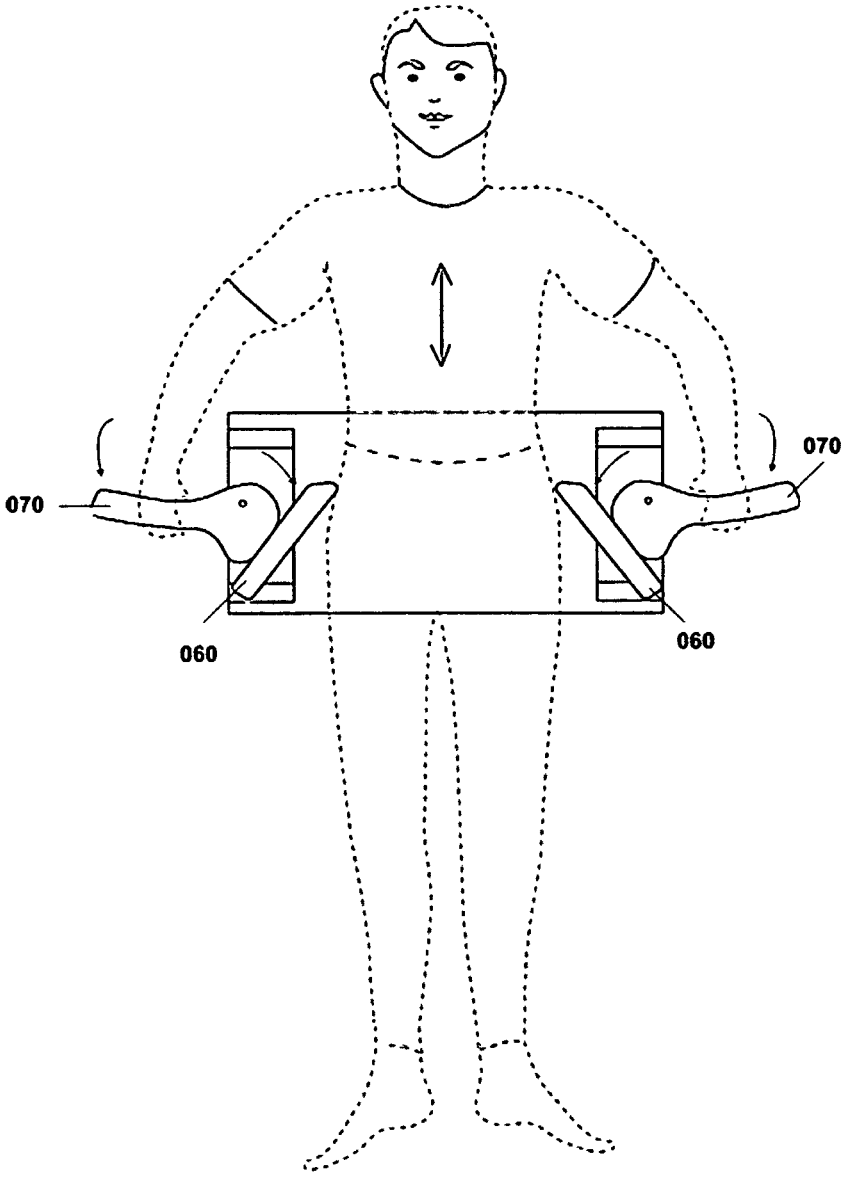
FIG. 2 shows a representation of the activation of a cam stop embodiment, the preferred embodiment, of the present invention and the resultant movement of the spinal column.
Figure 3:
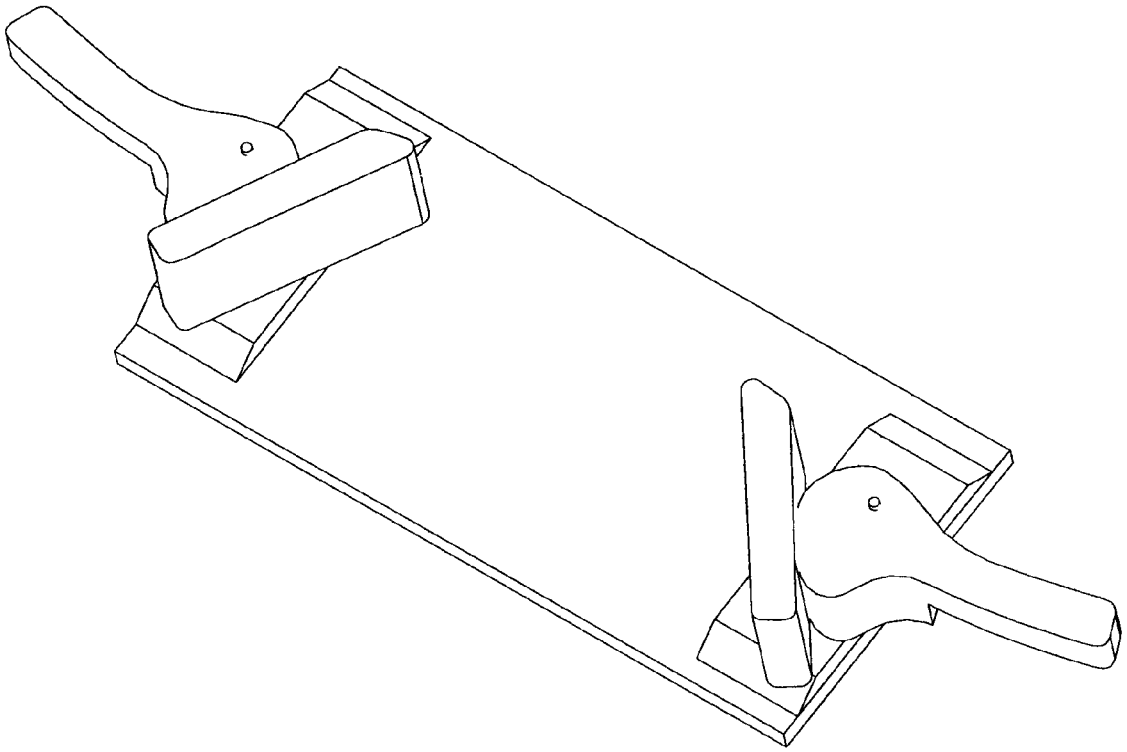
FIG. 3 shows a top perspective view of a cam stop embodiment, the preferred embodiment, of the present invention in the activated position.
Figure 4:
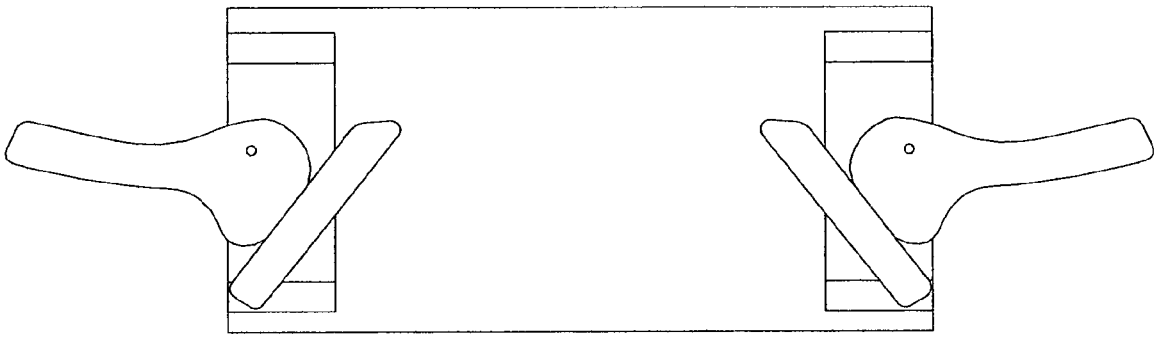
FIG. 4 shows a top plan view of a cam stop embodiment, the preferred embodiment, of the present invention in the activated position.
Figure 5:
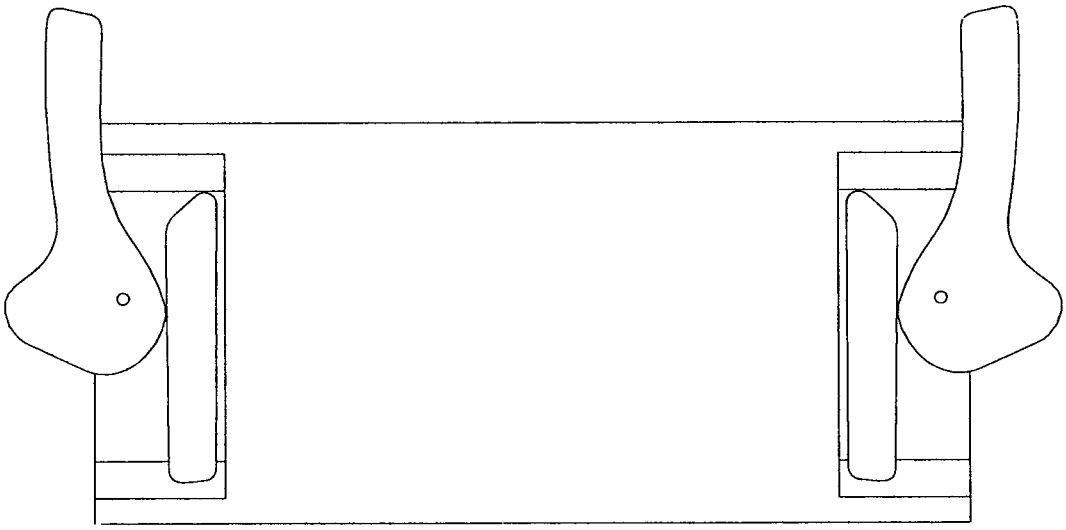
FIG. 5 shows a top plan view of a cam stop embodiment, the preferred embodiment, of the present invention in the static position.
Figure 6:
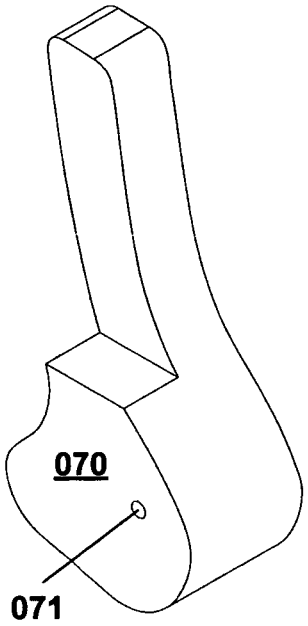
FIG. 6 shows a perspective view of a cam stop lever element according to a preferred embodiment of the present invention.
Figure 7:
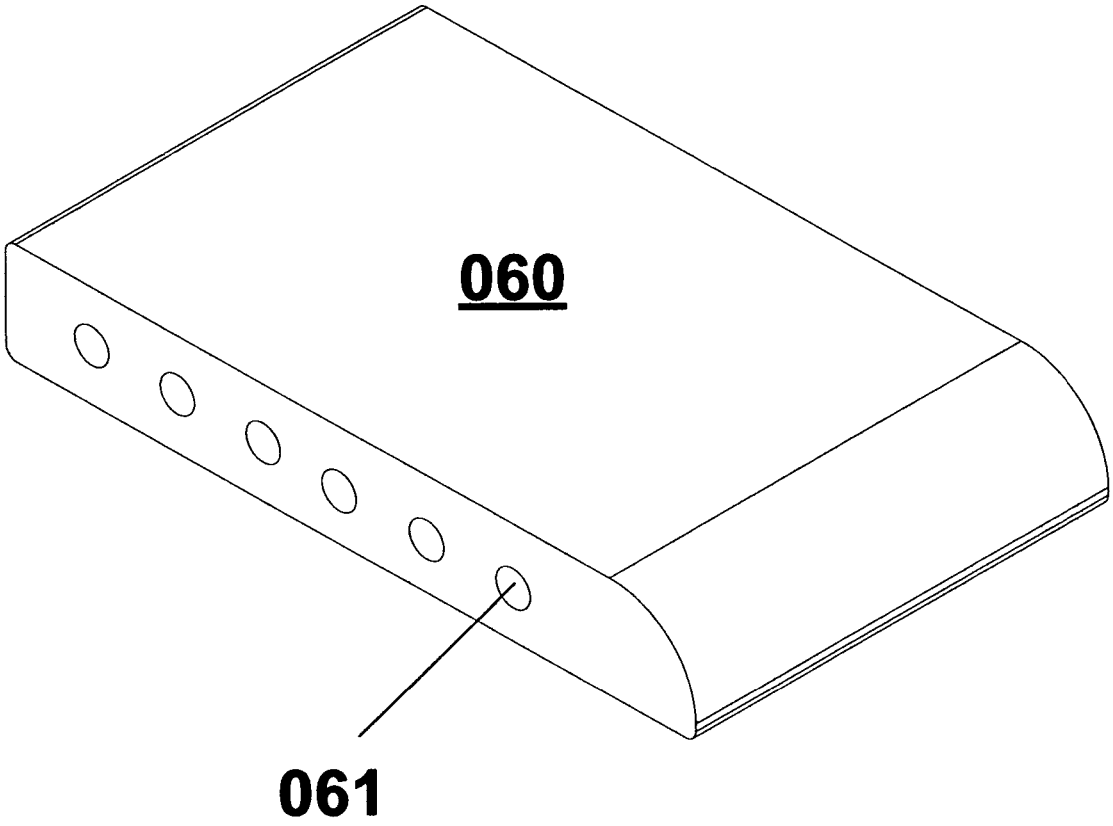
FIG. 7 shows a perspective view of a cam stop squeeze panel element according to a preferred embodiment of the present invention.
Figure 8:
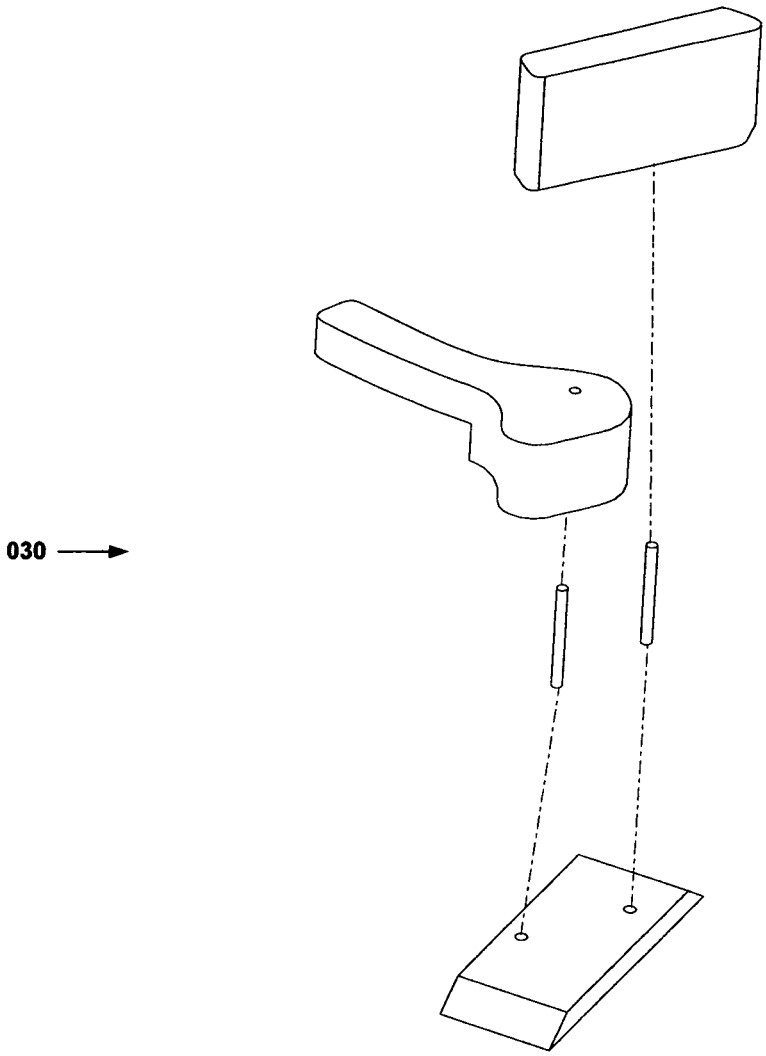
FIG. 8 shows an exploded view of a mount assembly according to a preferred embodiment of the present invention.
Figure 9:
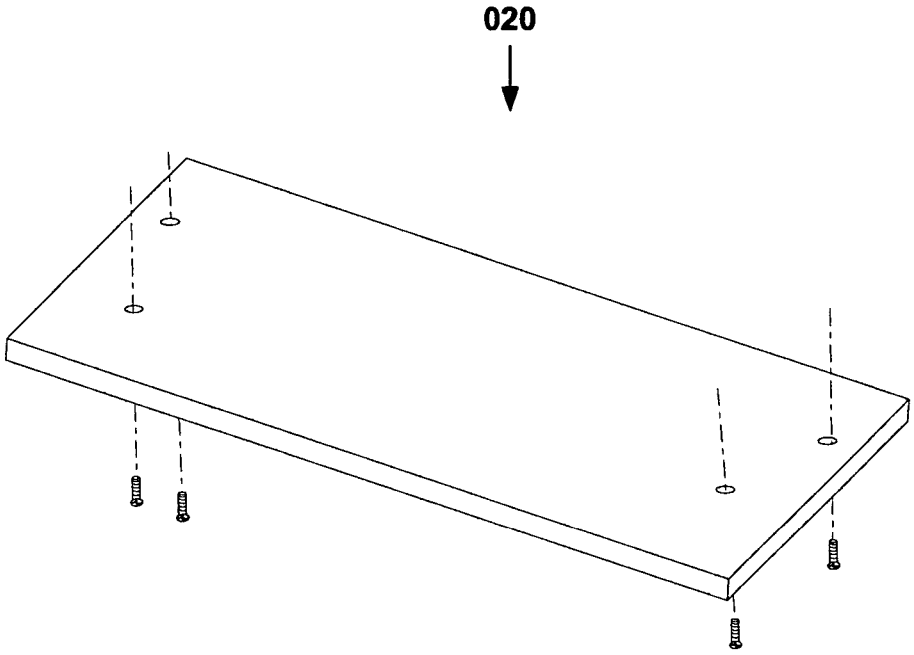
FIG. 9 shows an exploded view of base assembly according to a preferred embodiment of the present invention.
Figure 10:
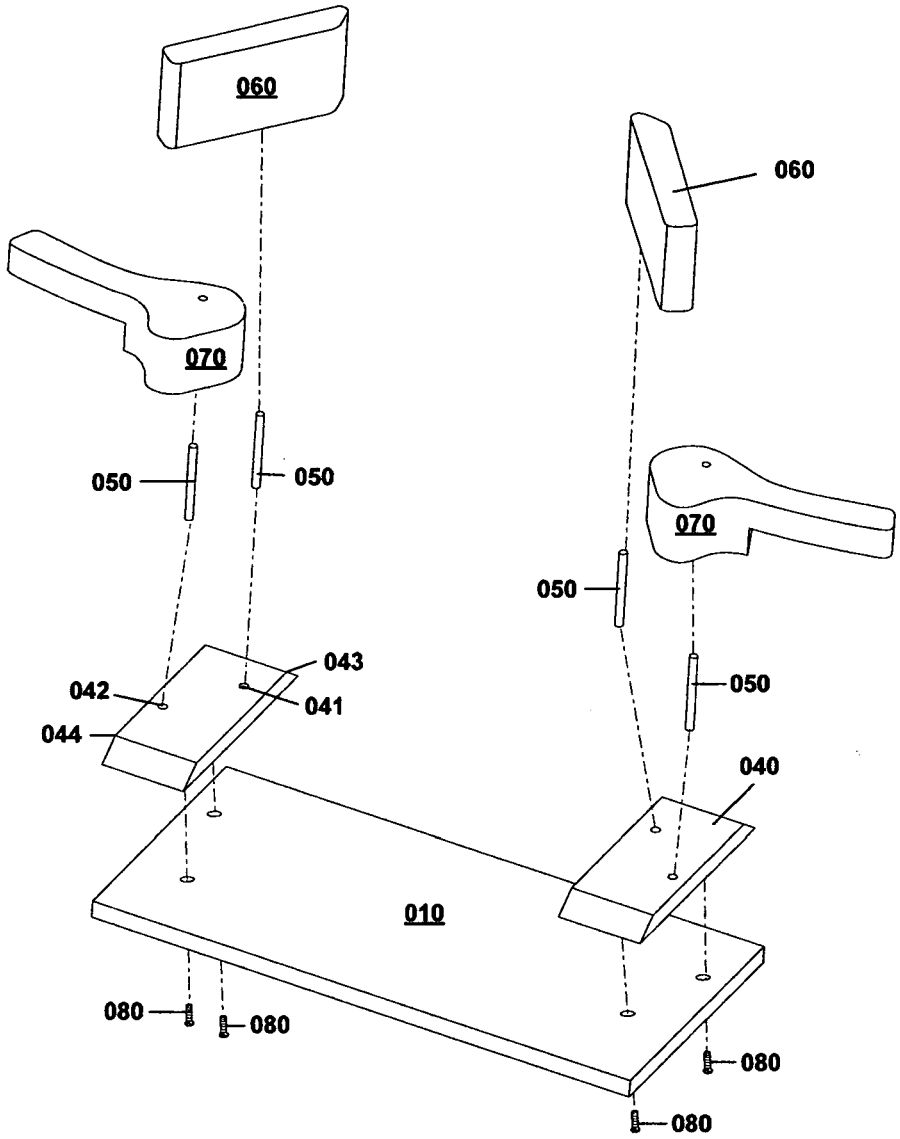
FIG. 10 shows an exploded view of a pelvic clamp for back stretching according to a preferred embodiment of the present invention.
Figure 11:
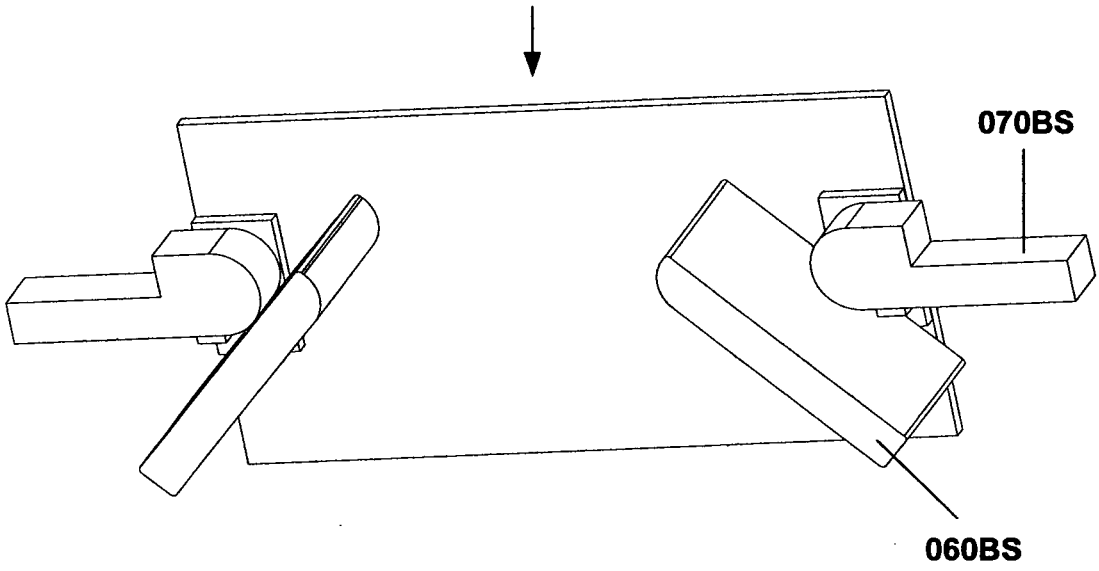
FIG. 11 shows a top perspective view of a block stop embodiment of a pelvic clamp for back stretching in the activated position.
Figure 12:
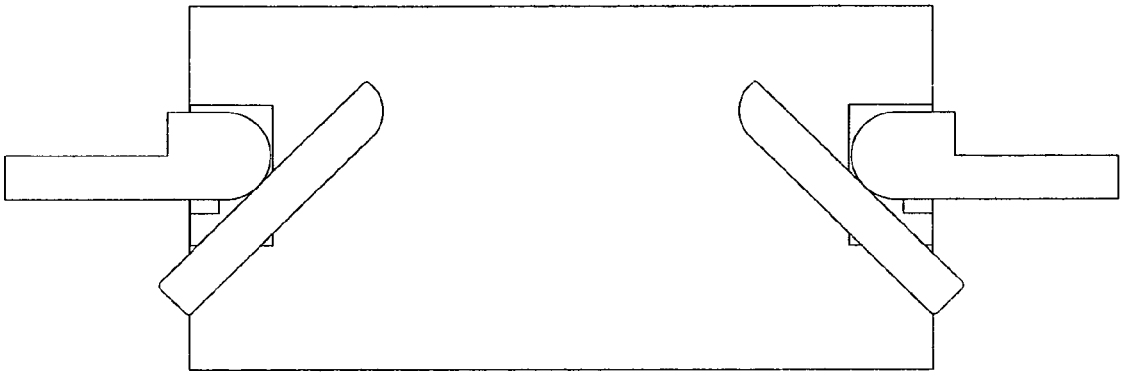
FIG. 12 shows a top plan view of a block stop embodiment of a pelvic clamp for back stretching in the activated position.
Figure 13:
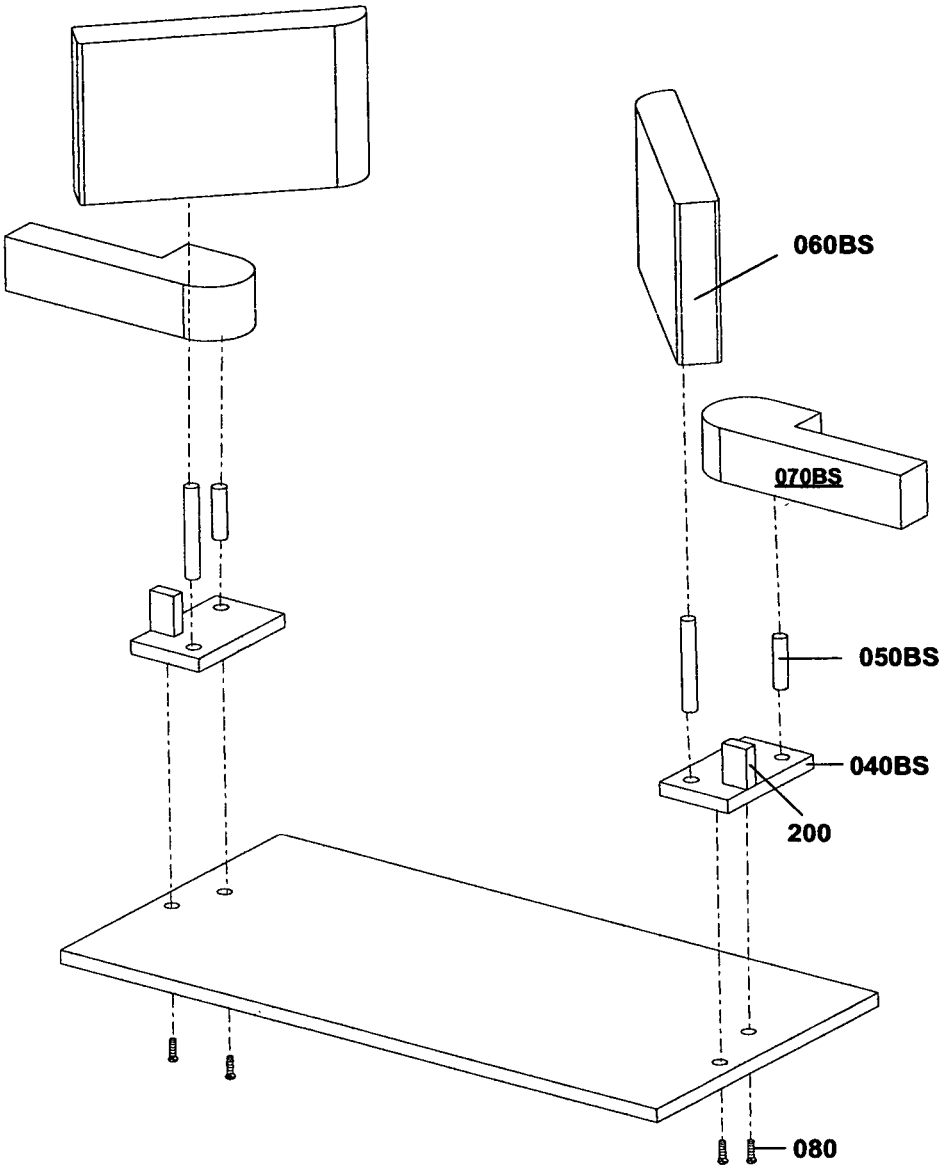
FIG. 13 shows an exploded view of a block stop embodiment of a pelvic clamp for back stretching.
Figure 14:
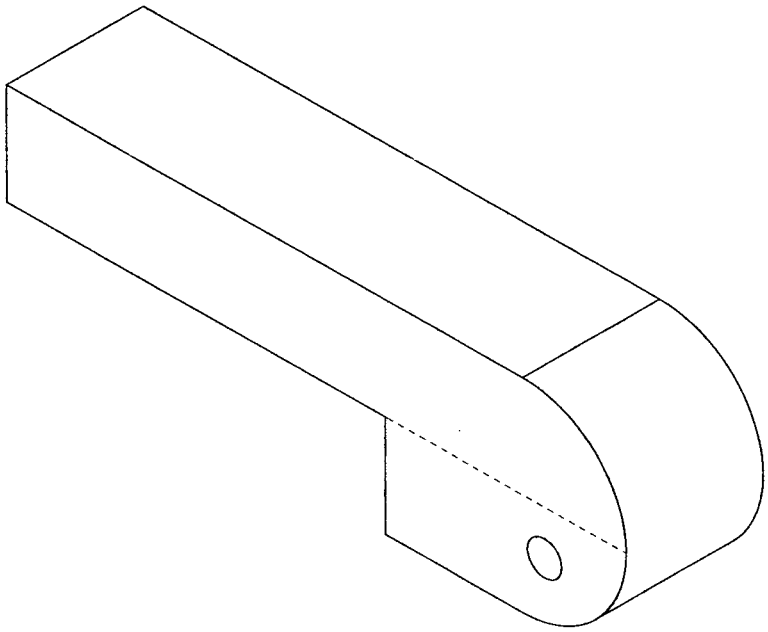
FIG. 14 shows a perspective view of a block stop lever according to an embodiment of the present invention.
Figure 15:
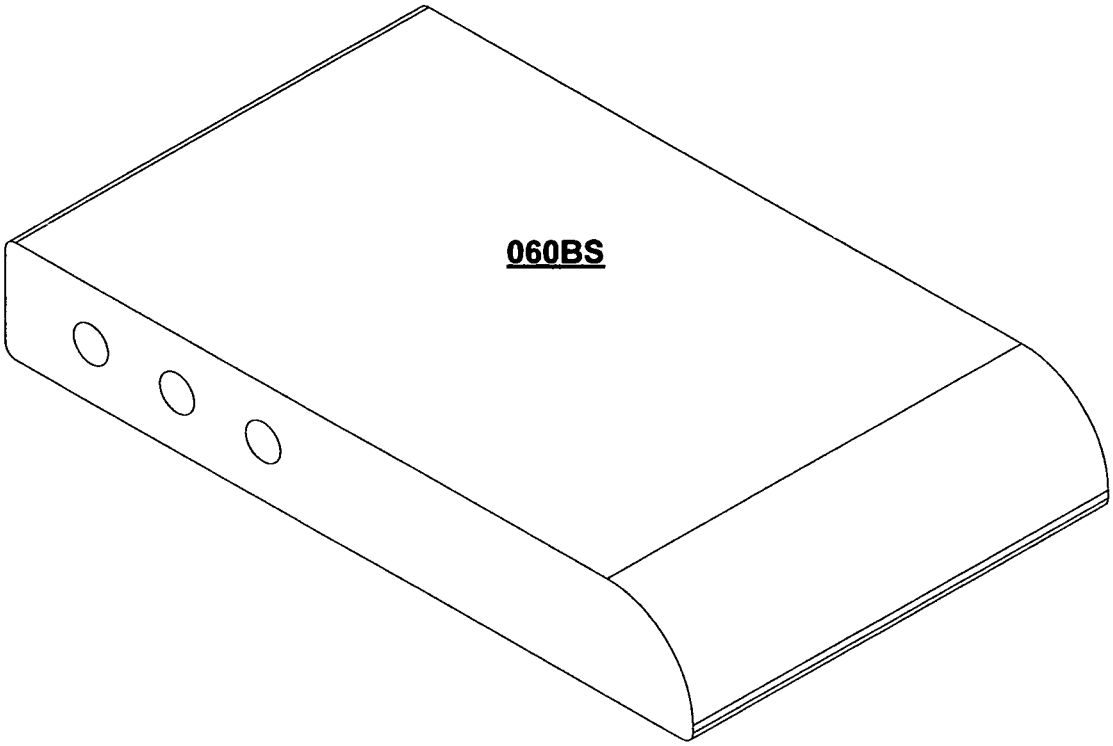
FIG. 15 shows a perspective view of a block stop squeeze panel element according to a preferred embodiment of the present invention.

The present invention works by holding the pelvic region stationary while the user applies pressure to both levers simultaneously to force the upper torso away from the pelvic region. This is a stretching action, which helps to stretch the lumbar region. The user simply lies on his back with his hips on the invention base, positions himself so that both squeeze panel tips contact the soft tissue between the pelvis and top of the femur on each side. Then the user applies pressure on both levers to engage both squeeze panels to hold the pelvic area stationary. While continuing to apply pressure on the handles with varying degrees of force the user counter pushes the shoulders and upper torso away from the hips to stretch the lumbar area.

Referring now to FIG. 1 through FIG. 10, the preferred embodiment, cam stop device 1, works by holding the pelvic region stationary while the user pushes on each cam lever 070 to force the pelvic region away from the upper torso. This is a stretching action, which separates the lumbar region. The user simply lies on their back with their hips on the invention base, positions themselves so that both squeeze panel tips contact the soft tissue between the pelvis and top of the femur on each side. Then the user pushes down on both cam levers 070 to engage both squeeze panels 060 to hold the pelvic area stationary. While continuing to push down on the handles with varying degrees of pressure the user counter pushes the shoulders and upper torso away from the hips to stretch the lumbar area. The preferred embodiment of the present invention is made entirely of wood, metal screws, and bolts. However, other materials, e.g. plastic, or light weight metal, may be used.

Base assembly 020 is the foundation to which all other parts are mounted and is comprised of base 010 and a plurality of wood screw 080. Base 010 is preferably made from cabinet finish type plywood, with dimensions of 2'×1'×0.5". Two of mount assembly 030 are mounted to each end of base assembly 020. Each mount assembly is comprised of mount 040, which is preferably a standard finished two by four board beveled to 45 degrees at both ends and being 4.5 inches long on the top shortest surface. Mount 040 is further comprised of first pivot hole 041 and second pivot hole 042. First pivot hole 041 and second pivot hole 042 are both ⅜" in diameter. First pivot hole 041 is positioned approximately 1 inch diagonally from first corner 043. Second pivot hole 042 is positioned approximately 1 inch diagonally from second corner 044.

Pivot rod 050 is preferably ⅜"×4.5" carriage bolts, and both first pivot hole 041 and second pivot hole 042 are counter sunk to accommodate the carriage bolt heads on the bottom side of mount 040. One pivot rod 050 is inserted in first pivot hole 041 and another pivot rod 050 is inserted in second pivot hole 042, in preparation for the mounting of squeeze panel 060 and cam lever 070.

Each squeeze panel 060 mounts on the pivot rod that is further from the edge of the base. Squeeze panel 060 is preferably made of a 2"×6" standard finished board and is approximately 8' long with the ends rounded. Squeeze panel 060 preferably has six of squeeze panel adjustment hole 061, approximately ⅜" in diameter, along the bottom facing side of squeeze panel 060. These six holes are preferably 0.25" apart starting 2" from one end of squeeze panel 060. These holes allow for moving each squeeze panel 060 to the hole that will accommodate the girth of the user's hips firmly when activated.

Cam lever 070 is preferably fashioned from a 2"×6" standard finished board with one end shaped into a handle and the other end having a curve, e.g. an are of approximately a 2" radius, to contact squeeze panel 060. Cam lever 070 preferably has cam hole 071 that is a roughly ⅜" perpendicular hole, approximately 1.5" from the curved end for mounting on the appropriate pivot rod 050. Pivot rod 050 is preferably off-center of the 2' radius center by about 0.5" so that the rotation of cam lever 070 creates a cam action with squeeze panel 060.

All these parts: mount 040, pivot rods 050, squeeze panel 060, and cam lever 070 make up mount assembly 030. Each mount assembly 030 is then mounted to base assembly 020 using two 1.5"×0.38" wood screw 080. One mount assembly 030 is placed flush with one of the short sides of base assembly 020 and preferably 2" from one of the long sides of base assembly 020. The other mount assembly 030 is placed flush with the opposite side of base assembly 020 and preferably 2" from the long side of base assembly 020. The short sides of base assembly 020 are preferably 1 foot in length. The long sides of base assembly 020 are preferably 2 feet in length. Each mount assembly 030 is held in place with two 1.5"× 0.38" wood screws placed through the bottom side of base assembly 020 so that the wood screws each penetrate through mount assembly 030 approximately 1" from the long side and 1" from the short side of mount assembly 030 and on the opposite corner from which pivot rod 050 is mounted.

Referring now to FIG. 11 through FIG. 15, an alternate embodiment is shown illustrating block stop device 2, block stop lever 070BS, block stop squeeze panel 060BS, block stop pivot rod 050BS, block stop mount 040BS, wood screw 080 and block stopper 200.

Figure 16:
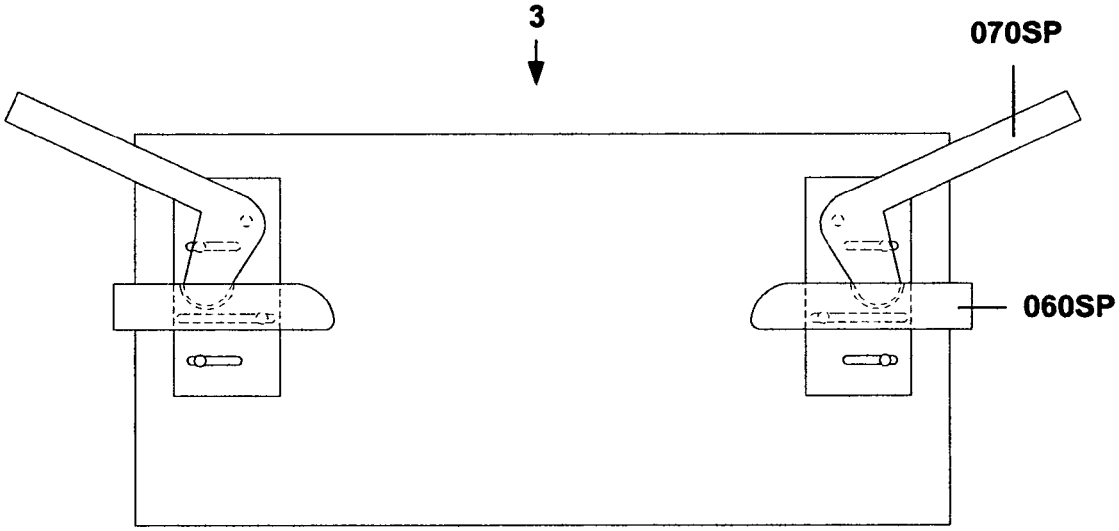
FIG. 16 shows a top plan view of a slide panel pelvic clamp for back stretching in the static position according to an embodiment of the present invention.
Figure 17:
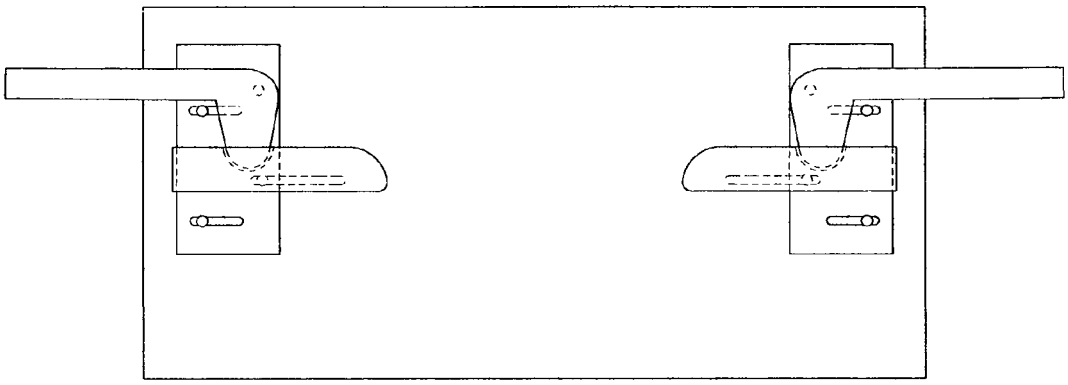
FIG. 17 shows a top plan view of a slide panel pelvic clamp for back stretching in the activated position according to an embodiment of the present invention.
Figure 18:
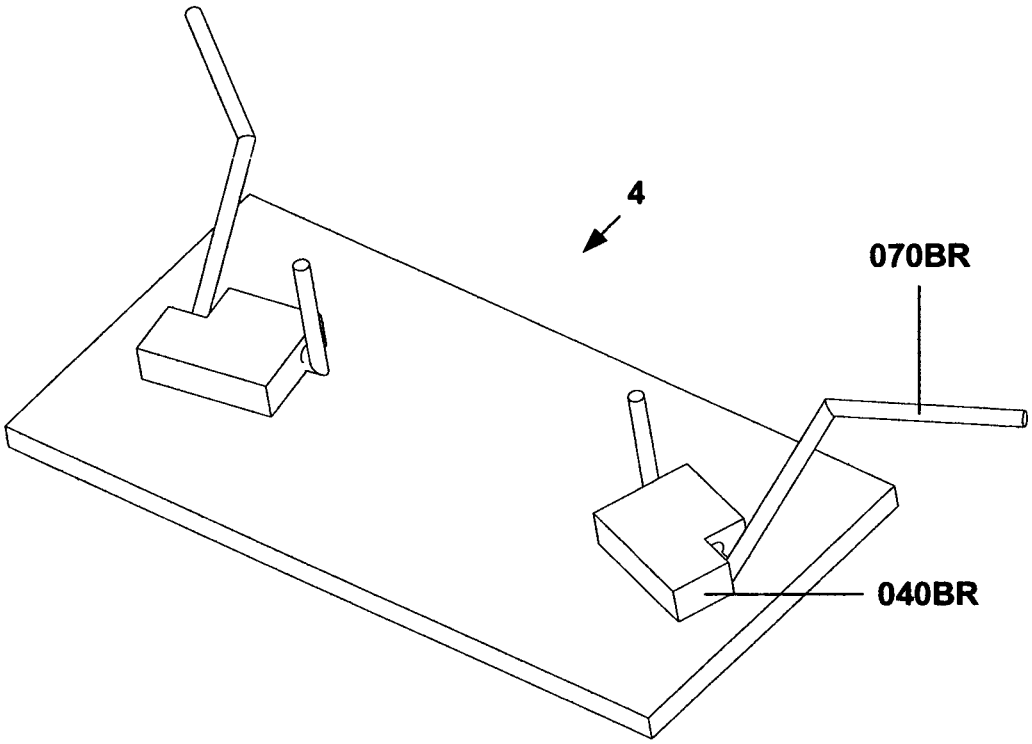
FIG. 18 shows a top perspective view of a bent rod pelvic clamp for back stretching in the activated position according to an embodiment of the present invention.
Figure 19:
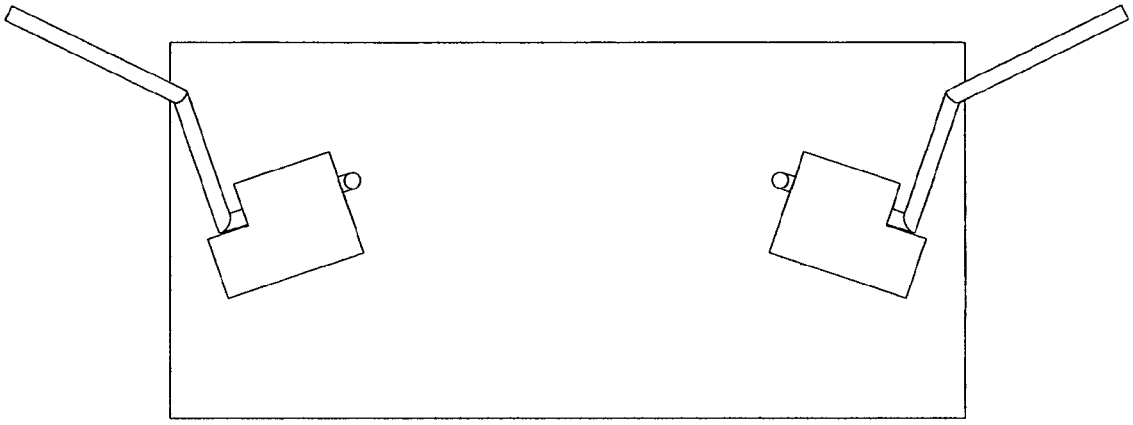
FIG. 19 shows a top plan view of a bent rod pelvic clamp for back stretching in the activated position according to an embodiment of the present invention.
Figure 20:
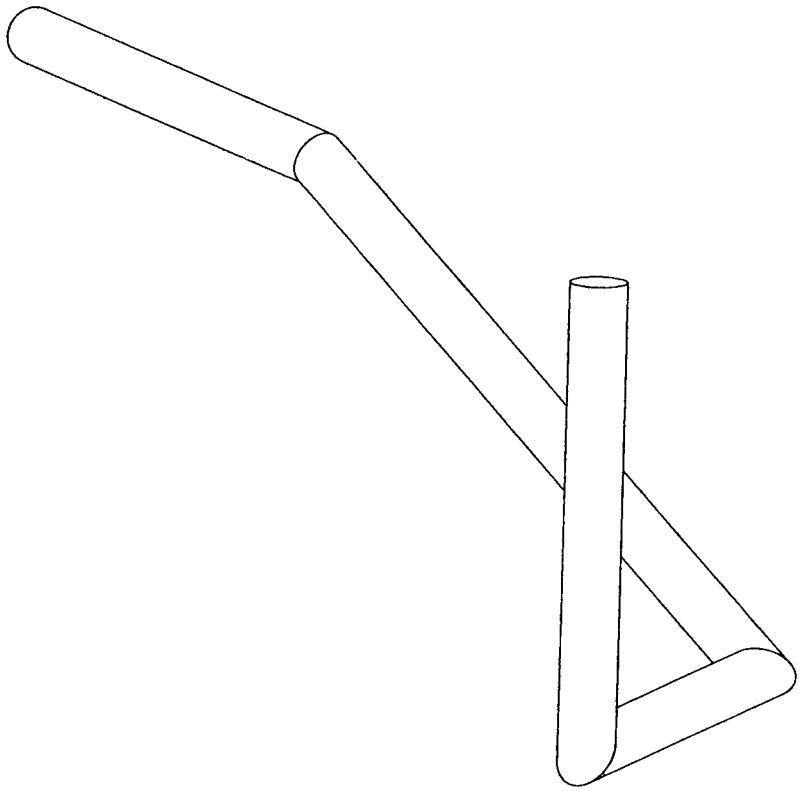
FIG. 20 shows a perspective view of a bent rod lever element according to an embodiment of the present invention.
Figure 21:
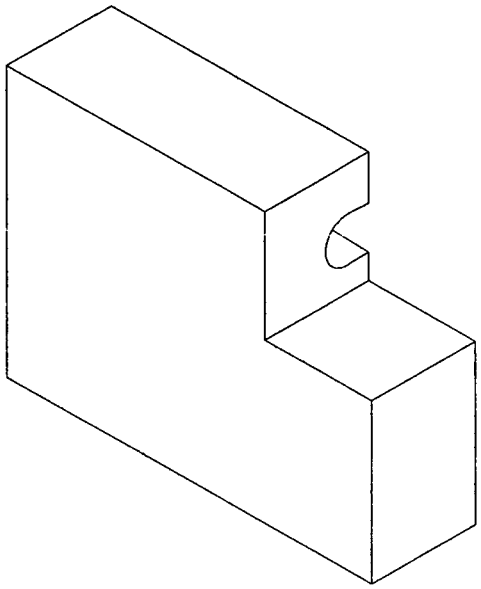
FIG. 21 shows a perspective view of a bent rod lever retainer according to a preferred embodiment of the present invention.
Figure 22:
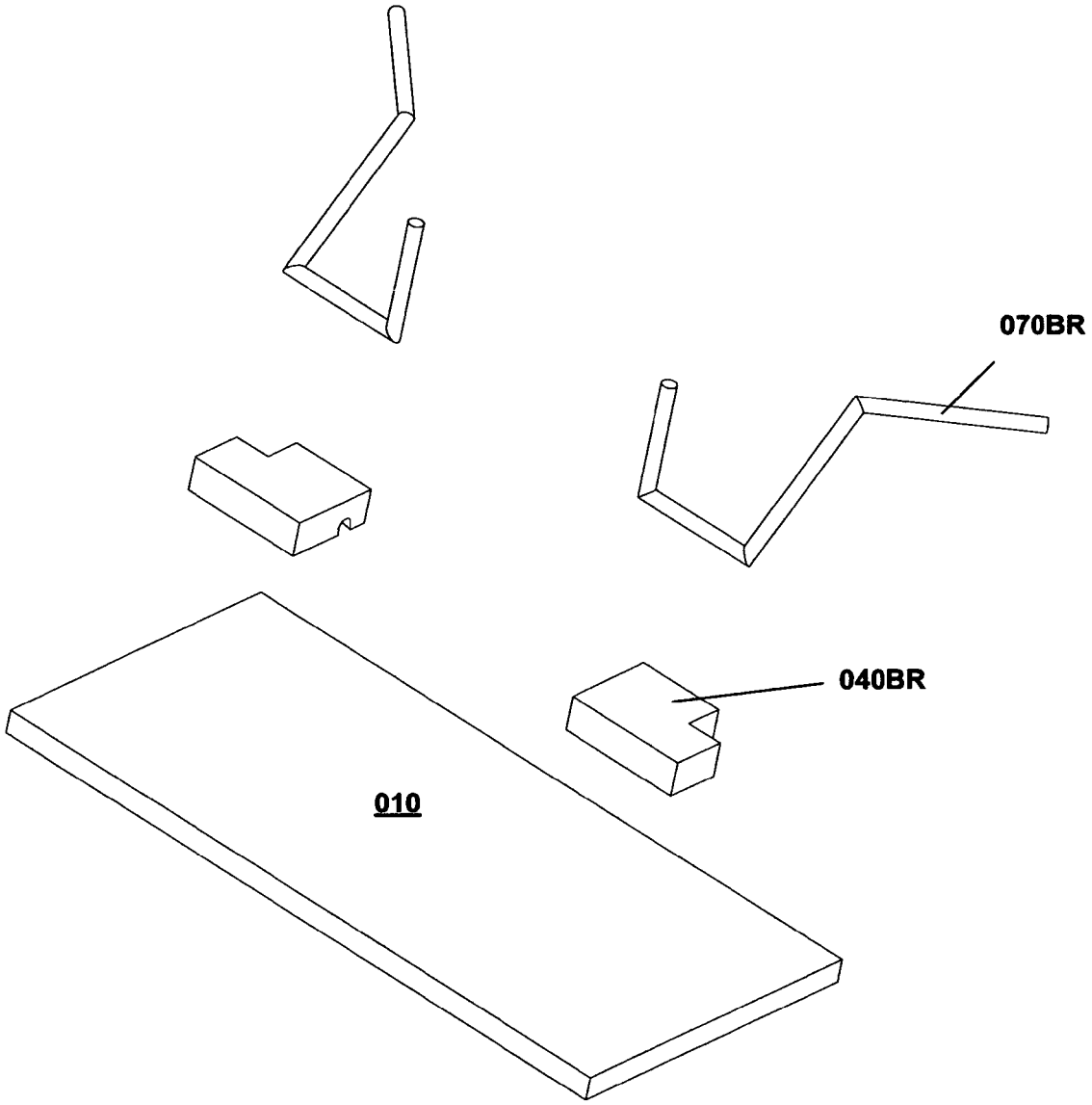
FIG. 22 shows an exploded view of a bent rod pelvic clamp for back stretching according to an embodiment of the present invention.

Referring now to FIG. 16 and FIG. 17, an alternate embodiment is shown illustrating slide panel device 3, slide panel lever 070SP and slide panel squeeze panel 060SP.

Referring now to FIG. 18 through FIG. 22, an alternate embodiment is shown illustrating bent rod device 4, bent rod mount 040BR, bend rod lever 070BR, and base 010.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred versions of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed is:

1. A portable light-weight user-operated apparatus useful for relieving back pain by engaging the soft tissue between a pelvis and a top of a femur on each side of a user for stretching the lumbar region by holding stationary a pelvic region of the user comprising:

A base configured to receive said user thereon in a supine position; and

A pair of opposing mount assemblies affixed to the base in position to receive said user there between, each mount assembly of said pair of mount assemblies comprised of a mount having a first pivot hole and a second pivot hole disposed therein, a squeeze panel having squeeze panel adjustment holes disposed therein and a cam lever having a cam hole disposed therein, a first connecting pivot rod inserted into one of said squeeze panel adjustment holes and said first pivot hole, and a second connecting pivot rod into said cam hole and said second pivot hole parallel to said first connecting pivot rod and spaced therefrom such that rotation of said cam lever about said second connecting pivot rod in each of said pair of mount assemblies by the hands of a user urges each cam lever against the squeeze panel of each of said pair of mount assemblies causing said squeeze panel to pivot about said first connecting pivot rod and engage the soft tissue between the pelvis and a top of a femur on one side of a user thereby holding stationary said pelvic region as said user applies force through his arms and shoulders towards said pelvic region.

2. A user-operated apparatus useful for relieving back pain by engaging the soft tissue between a pelvis and a top of a femur on each side of a user for stretching the lumbar region by holding stationary a pelvic region of the user comprising:

A base configured to receive said user thereon in a supine position; and

A pair of opposing mount assemblies affixed to the base in position to receive said user there between, each mount assembly of said pair of mount assemblies comprised of a squeeze panel and a cam lever, a first connecting pivot rod to which said squeeze panel is pivotally connected for rotation about said first connecting pivot rod and a second connecting pivot rod to which said cam lever is pivotally mounted for rotation about said second connecting pivot rod and extending parallel to said first connecting pivot rod and spaced therefrom such that rotation of said cam lever about said second connecting pivot rod in each of said pair of mount assemblies by the hands of a user urges each cam lever against the squeeze panel of each of said pair of mount assemblies causing said squeeze panel to pivot about said first connecting pivot rod and engage the soft tissue between the pelvis and a top of a femur on one side of a user thereby holding stationary said pelvic region as said user applies force through his arms and shoulders toward said pelvic region.

3. Apparatus as defined in claim 2 wherein said opposing squeeze panels are adjustable to accommodate different body sizes.

4. A user-operated apparatus useful for relieving back pain by engaging the soft tissue between a pelvis and a top of a femur on each side of a user for stretching the lumbar region by holding stationary a pelvic region of the user comprising:

A base configured to receive said user thereon in a supine position;

A pair of opposing squeeze panels each mounted for rotation about an associated axis substantially perpendicular to said base;

A pair of cam levers each abutting one of said pair of opposing squeeze panels and mounted for rotation about an axis offset from and parallel to each said associated axis such that movement of said cam levers responsive to manual urging of a user rotates said squeeze panels about said associated axis into engagement with the soft tissue between a pelvis and a top of a femur on each side of said user thereby holding stationary a pelvic region of the user as the user stretches his lumbar region by pressing on said cam levers.

5. Apparatus as defined in claim 4 further comprising a pair of squeeze panel pivot rods mounted to said base and extending perpendicular thereto along said associated axis' with each squeeze panel of said pair of squeeze panels mounted on one of said pair of squeeze panel pivot rods.

6. Apparatus as defined in claim 5 further comprising a pair of cam lever pivot rods mounted to said base and extending perpendicular thereto along said offset axis' with each cam lever of said pair of cam levers mounted on one of said pair of cam lever pivot rods.

* * * * *